US007736189B2

(12) United States Patent
Chan et al.

(10) Patent No.: US 7,736,189 B2
(45) Date of Patent: Jun. 15, 2010

(54) ROTATABLE BEARING BASE

(75) Inventors: Chun-Kai Chan, Taipei (TW); Li-Hsiang Liao, Taipei (TW); Fou-Ming Liou, Taipei (TW); Chih-Peng Wu, Taipei (TW)

(73) Assignee: Asustek Computer Inc., Taipei (TW)

( * ) Notice: Subject to any disclaimer, the term of this patent is extended or adjusted under 35 U.S.C. 154(b) by 0 days.

(21) Appl. No.: 12/366,016

(22) Filed: Feb. 5, 2009

(65) Prior Publication Data

US 2009/0258542 A1 Oct. 15, 2009

(30) Foreign Application Priority Data

Apr. 9, 2008 (TW) ..... 97112812 A

(51) Int. Cl.
*H01R 31/00* (2006.01)

(52) U.S. Cl. ..... 439/640; 361/679.45; 361/638

(58) Field of Classification Search ..... 439/638, 439/640, 165, 8, 10, 6; 361/679.45
See application file for complete search history.

(56) References Cited

U.S. PATENT DOCUMENTS 6,193,522 B1 * 2/2001 Liao ..... 439/640
6,366,672 B1 * 4/2002 Tsay ..... 379/446
6,480,378 B2 * 11/2002 Chang ..... 361/679.41
6,893,267 B1 * 5/2005 Yueh ..... 439/8
6,991,467 B1 * 1/2006 Cheng et al. ..... 439/640
7,012,403 B2 * 3/2006 Hwang ..... 439/638
7,121,852 B2 * 10/2006 Ng et al. ..... 439/165
7,140,922 B2 * 11/2006 Luu et al. ..... 439/651
2005/0079769 A1 * 4/2005 Strayer ..... 439/652

* cited by examiner

*Primary Examiner*—Briggitte R Hammond
(74) *Attorney, Agent, or Firm*—Morris, Manning & Martin LLP; Tim Tingkang Xia

(57) ABSTRACT

The invention provides a rotatable bearing base for fixing a peripheral electronic unit. The rotatable bearing base of the invention includes a pivot and a bearing portion. The pivot has two end surfaces and a lateral surface. A first connecting portion is disposed on one of the end surfaces for electrically connecting an electronic apparatus. At least a second connecting portion is disposed on the lateral surface for electrically connecting the peripheral electronic unit. Additionally, the bearing portion is elongated from the lateral surface. The peripheral electronic unit leans against the bearing portion when it is electrically connected to the second connecting portion.

16 Claims, 9 Drawing Sheets

ROTATABLE BEARING BASE

CROSS-REFERENCE TO RELATED APPLICATIONS

This non-provisional application claims priority under 35 U.S.C. §119(a) on Patent Application No. 097112812 filed in Taiwan on Apr. 9, 2008, the entire contents of which are hereby incorporated by reference.

BACKGROUND OF THE INVENTION

1. Field of the Invention

The present invention relates to a rotatable bearing base; and more particularly, the rotatable bearing base can assist a peripheral electronic unit to electrically connect with an electronic apparatus.

2. Description of the Prior Art

With the vigorous development of the electronic information related industry, many electronic and information products are designed to be multi-function and thin products, and therefore facilitate a user to carry and use anytime and anywhere. Taking notebooks as an example, products with lightness and thinness, high capacity batteries and complete functionality have already been on the market. These advantages make the user able to operate these products for a long time at any desired place and bring enormous convenience.

Additionally, taking a Universal Serial Bus (USB) peripheral electronic unit (such as a keychain drive, a television box, a fan, a lighting unit, etc.) as an example, it is popular for computer users because it is easy to operate by connecting it with the USB port of the computer only.

Please refer to FIG. 1. FIG. 1 is a schematic diagram illustrating that a USB peripheral electronic unit 72 is connected to a notebook 7 according to prior art. As shown in FIG. 1, the USB peripheral electronic unit 72 is usually plugged into a USB connection port 70 which is at one side of the notebook 7, thus connects electrically to a processing module (not shown in the figure) of the notebook 7 to carry on an action such as information processing or transmitting.

For example, when the USB peripheral electronic unit 72 is a keychain drive, it can communicate and store the data inside itself or inside the notebook 7. Moreover, when the USB peripheral electronic unit 72 is a television box, it can receive a television signal via an antenna and transmit the television signal to the notebook 7. After processing, the television signal is broadcasted on the notebook 7 to allow the user to watch TV.

Most of the USB peripheral electronic units are connected to computers or other electronic apparatuses by the plugging method shown in FIG. 1. This connection method is simple and convenient; however, the USB peripheral electronic units may naturally droop because of their weight, and even cause bad contact and unstable electrical connection problems. Additionally, this type of connection method is also easy to make the USB peripheral electronic units fall off from their connecting electronic apparatuses because of external force collision, and then cause accidental conditions such as the transmission interruption, the data damage, the electronic apparatus breakdown, etc. These problems are also easily happened on other connection ports (for example, Mini USB connection port, IEEE 1394 connection port or other connection ports) and their corresponding peripheral electronic units.

SUMMARY OF THE INVENTION

Accordingly, an aspect of the present invention is to provide a rotatable bearing base for fixing a peripheral electronic unit to solve the aforementioned problem.

According to a preferred embodiment, the rotatable bearing base of the invention comprises a pivot and a bearing portion. The pivot has two end surfaces and a lateral surface. A first connecting portion is disposed on one of the end surfaces for electrically connecting an electronic apparatus. Additionally, at least a second connecting portion is disposed on the lateral surface for electrically connecting the peripheral electronic unit. Furthermore, the bearing portion is elongated from the lateral surface. The peripheral electronic unit leans against the bearing portion when it is electrically connected to the second connecting portion.

Therefore, the rotatable bearing base of the invention can support the peripheral electronic unit, preventing the peripheral electronic unit from naturally drooping because of its weight, and even causing bad contact and unstable electrical connection problems. Moreover, the rotatable bearing base of the invention can also protect the peripheral electronic unit away from disturbance of an external force collision.

The objective of the present invention will no doubt become obvious to those of ordinary skill in the art after reading the following detailed description of the preferred embodiment, which is illustrated in following figures and drawings.

BRIEF DESCRIPTION OF THE APPENDED DRAWINGS

DETAILED DESCRIPTION OF THE INVENTION

The invention provides a rotatable bearing base for fixing a peripheral electronic unit. In practice, the rotatable bearing base of the invention can fix suitable peripheral electronic units, for example, such as, but not limited to a storage unit, a wireless transceiver, etc. Moreover, the storage unit may be, but not limited to a flash memory storage unit. The wireless transceiver may be, but not limited to an infrared transceiver, a bluetooth transceiver, a digital television transceiver, a global positioning system transceiver and a wireless network transceiver.

Figure 1:
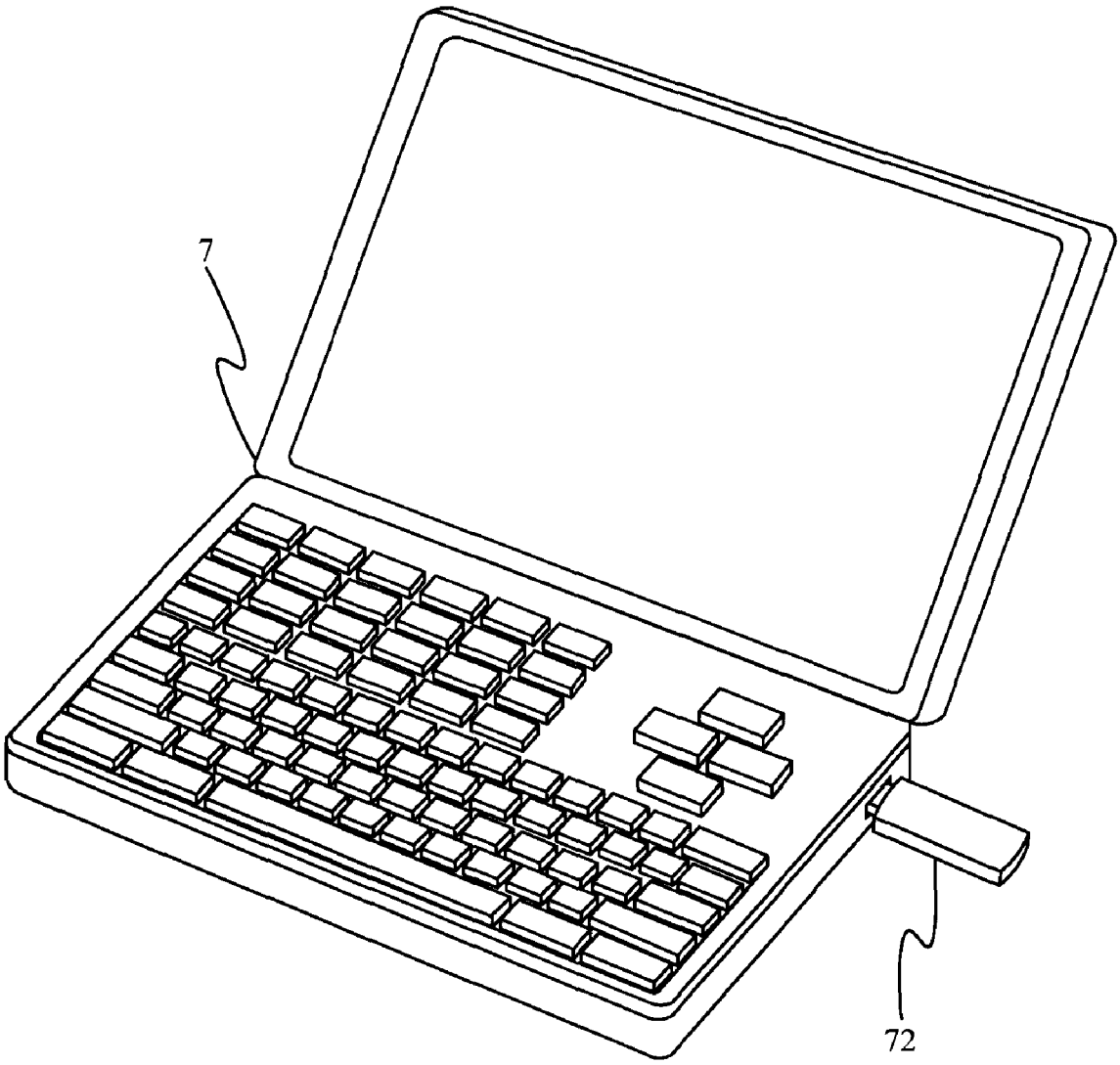
FIG. 1 (PRIOR ART)
FIG. 1 is a schematic diagram illustrating that a USB peripheral electronic unit is connected to a notebook according to prior art.
Figure 2A:
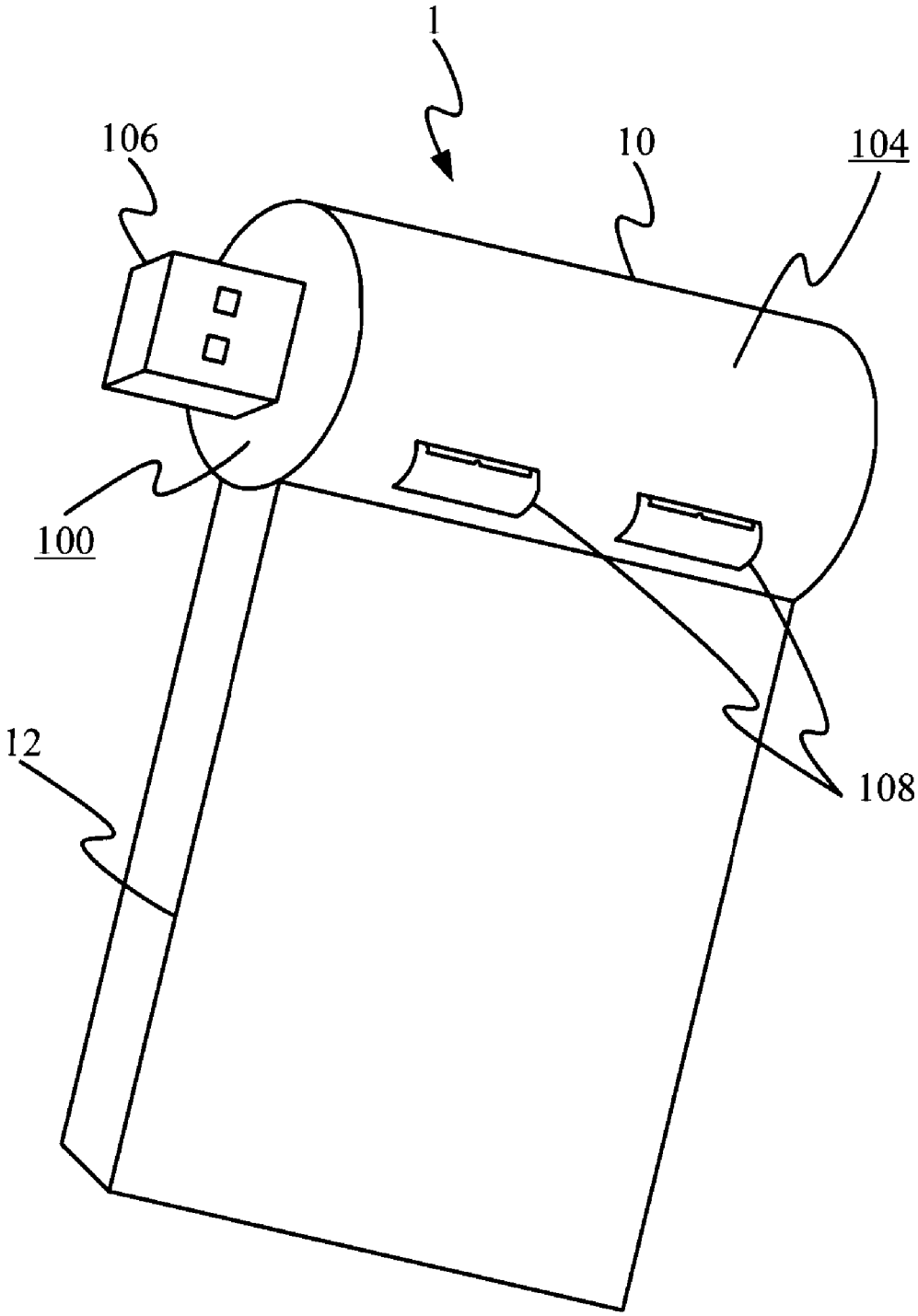
FIG. 2A is a pictorial view illustrating a rotatable bearing base according to an embodiment of the invention.
Figure 2B:
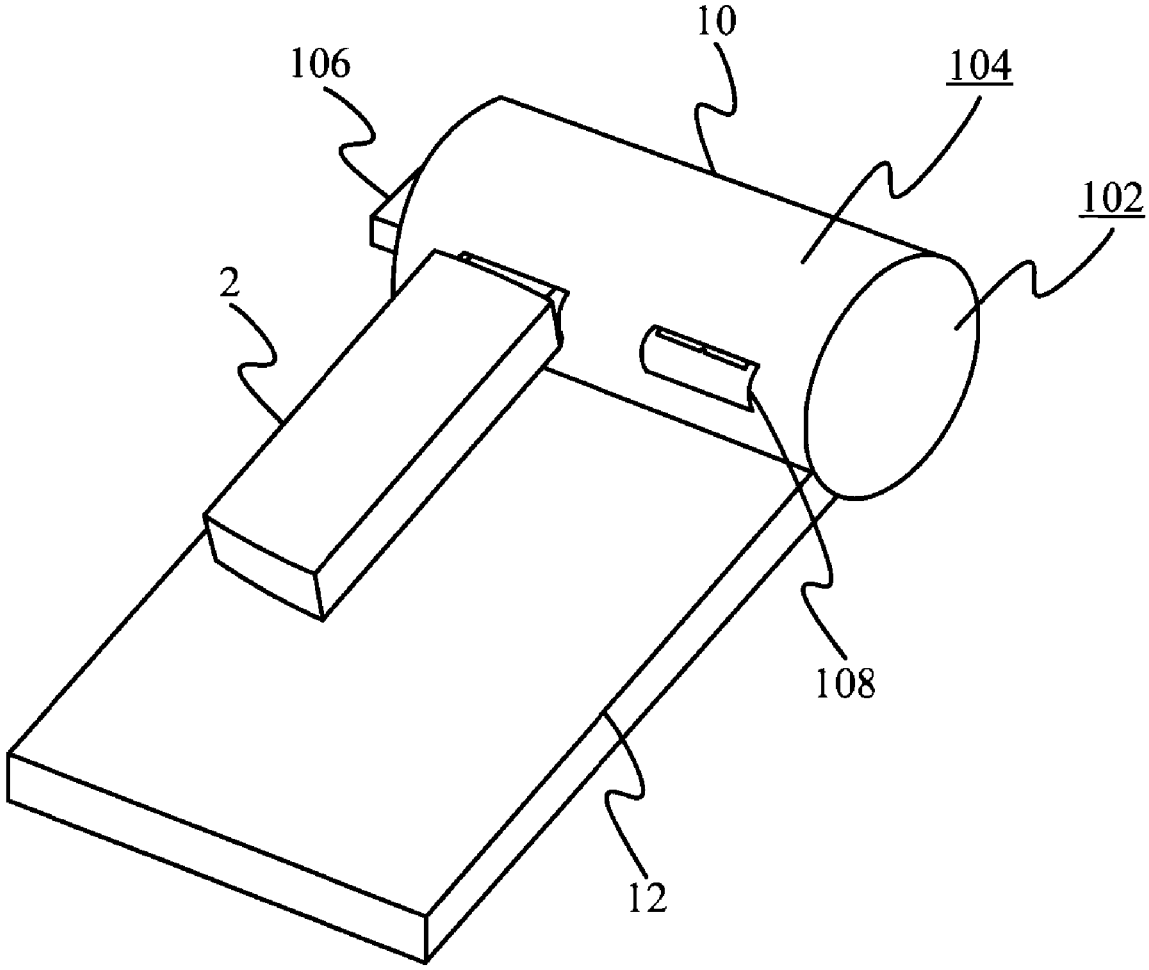
FIG. 2B is a pictorial view illustrating that the rotatable bearing base of FIG. 2A fixes a peripheral electronic unit.

Please refer to FIG. 2A and FIG. 2B. FIG. 2A is a pictorial view illustrating a rotatable bearing base according to an embodiment of the invention. FIG. 2B is a pictorial view illustrating that the rotatable bearing base of FIG. 2A fixes a peripheral electronic unit. In the embodiment, the rotatable bearing base 1 comprises a pivot 10 and a bearing portion 12.

The pivot 10 has a first end surface 100, a second end surface 102 corresponding to the first end surface 100, and a lateral surface 104. A first connecting portion 106 is disposed on the first end surface 100 for electrically connecting an electronic apparatus (not shown in the figure). Additionally, at least a second connecting portion 108 is disposed on the lateral surface 104 for electrically connecting the peripheral electronic unit 2.

Besides, the bearing portion 12 is elongated from the lateral surface 104. As shown in FIG. 2B, the peripheral electronic unit 2 leans against the bearing portion 12 when it is electrically connected to the second connecting portion 108. Accordingly, the bearing portion 12 provides a support needed by the peripheral electronic unit 2 and makes the peripheral electronic unit 2 to be fixed stably on the rotatable bearing base 1 of the invention.

In practice, the first connecting portion 106 and the second connecting portion 108 could be USB connecting portions (for example, standard USB connecting portions, Mini USB connecting portions, Micro USB connecting portions) or other suitable connecting portions, for example, may be but not limited to IEEE 1394 connecting portions. Additionally, the numbers and the positions of the first connecting portion 106 and the second connecting portion 108 can be optionally adjusted but not limited to the examples here.

Figure 3A:
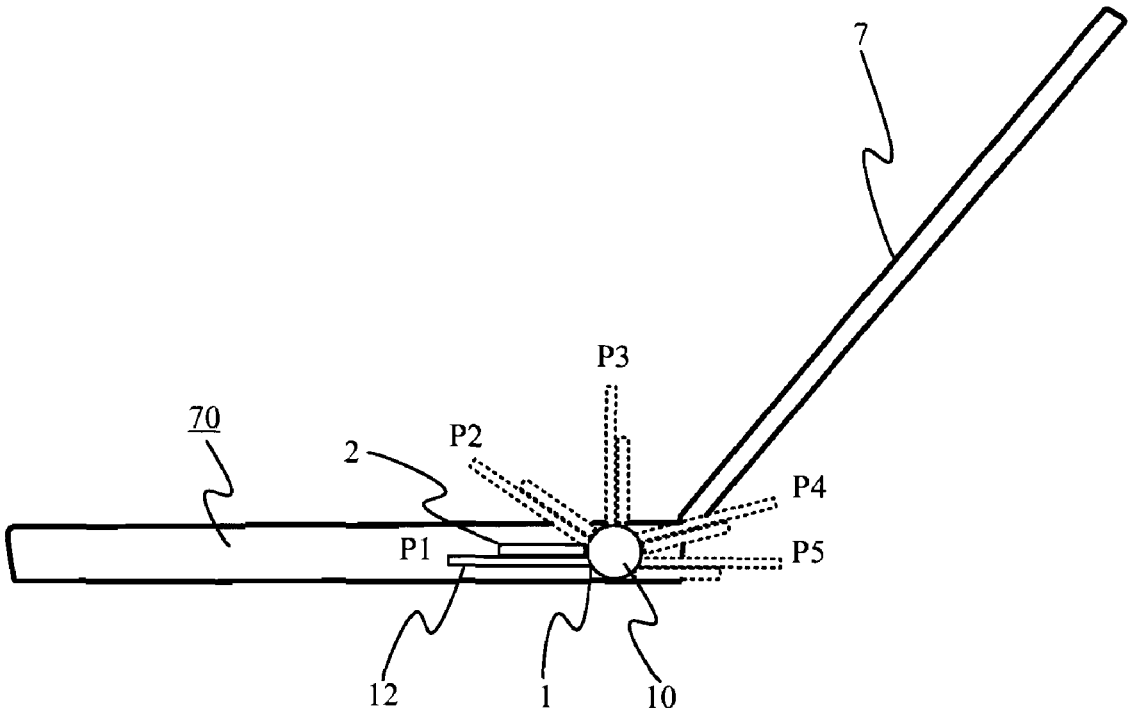
FIG. 3A is a side view illustrating that the rotatable bearing base is connected to a notebook according to an embodiment of the invention.
Figure 3B:
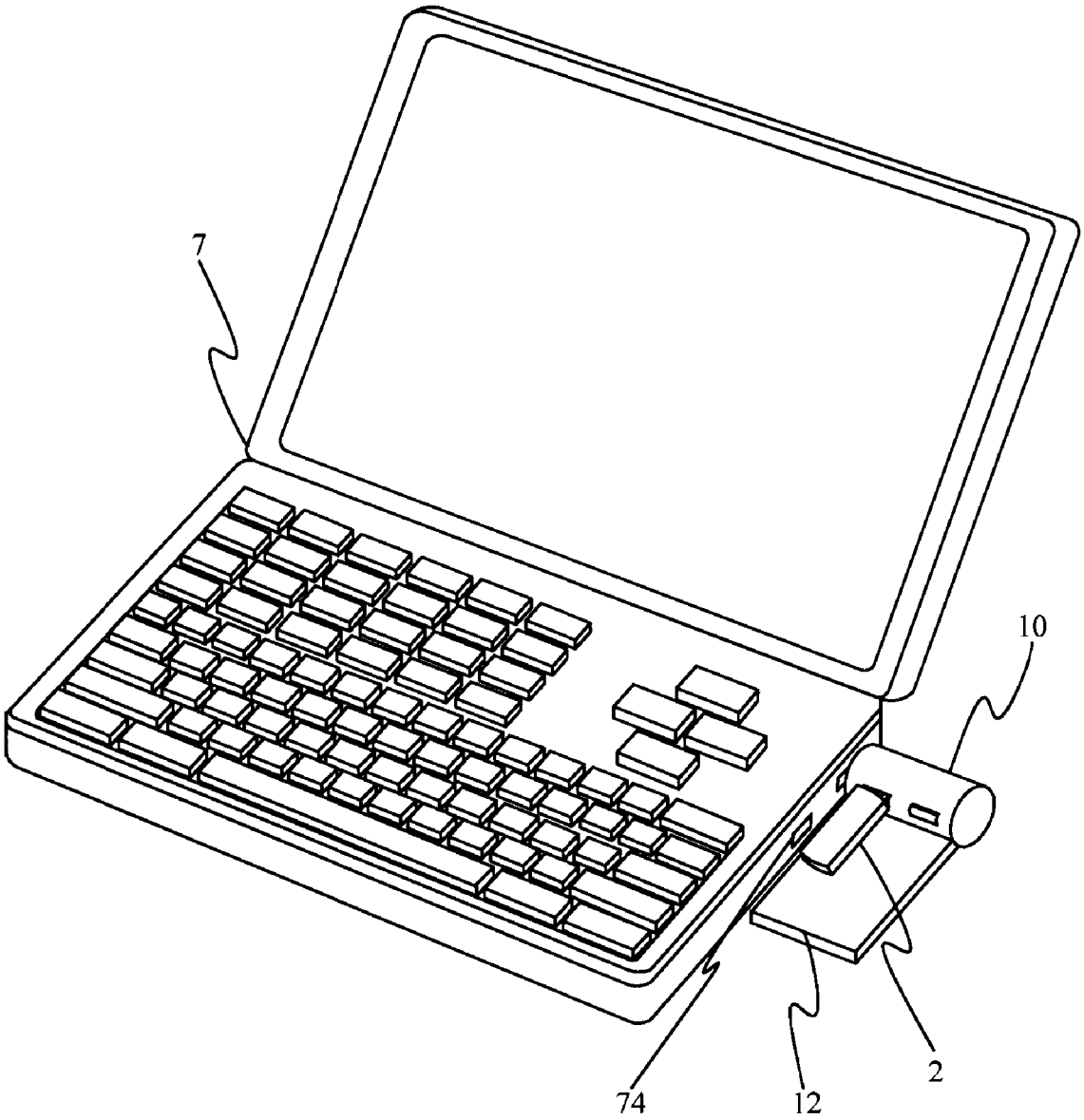
FIG. 3B is a pictorial view illustrating the rotatable bearing base of FIG. 3A at position P1.
Figure 3C:
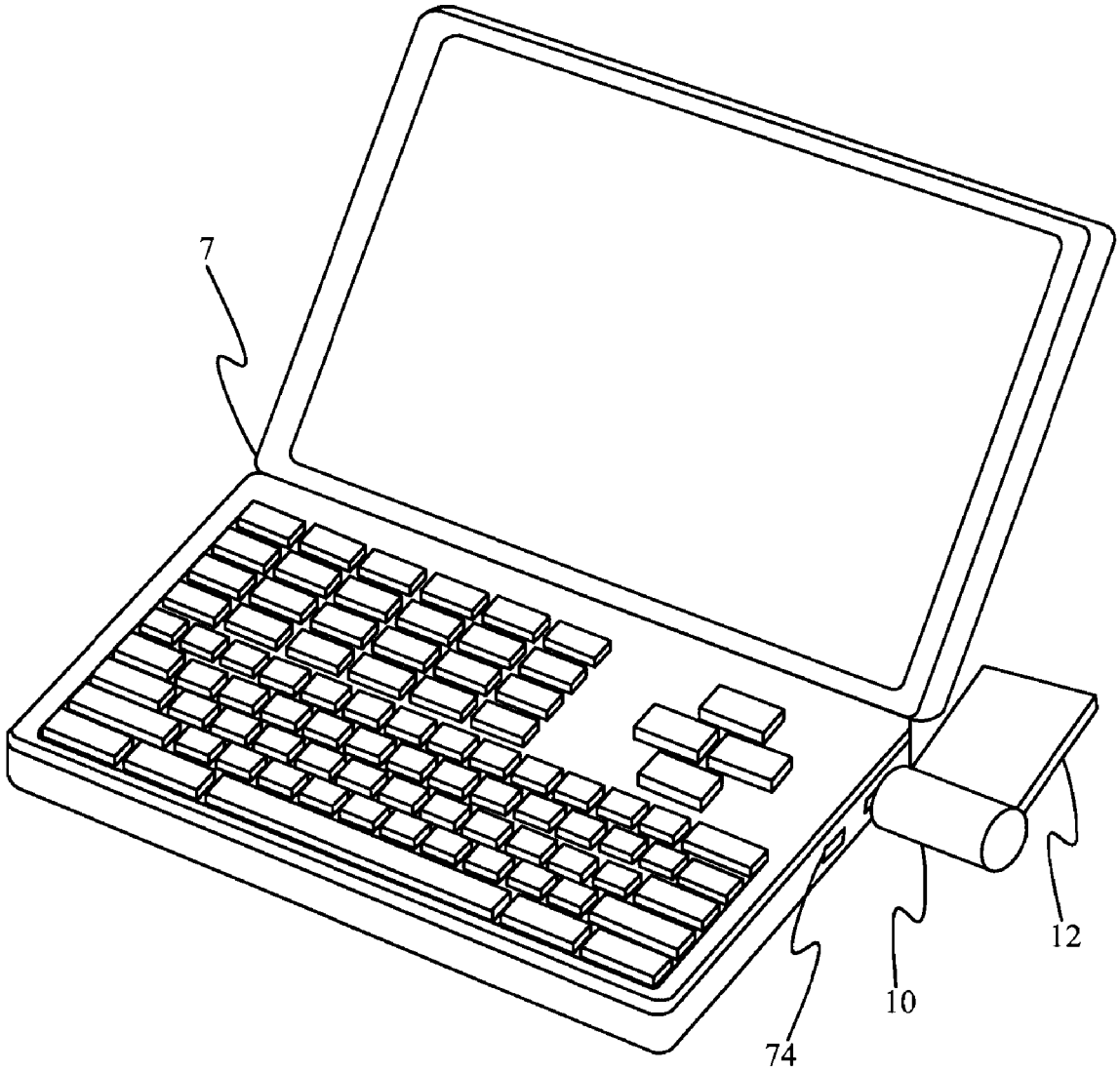
FIG. 3C is a pictorial view illustrating the rotatable bearing base of FIG. 3A at position P5.

Please refer to FIG. 3A to FIG. 3C. FIG. 3A is a side view illustrating that the rotatable bearing base is connected to a notebook according to an embodiment of the invention. FIG. 3B is a pictorial view illustrating the rotatable bearing base of FIG. 3A at position P1. FIG. 3C is a pictorial view illustrating the rotatable bearing base of FIG. 3A at position P5.

As shown in FIG. 3A, when the first connecting portion (not shown in the figure) of the rotatable bearing base of the invention is connected to a connecting jack (not shown in the figure) on a lateral surface 70 of a notebook 7, the bearing portion 12 of the rotatable bearing base 1 and the peripheral electronic unit 2 borne on the bearing portion 12 can revolve on the pivot 10, for example, from position P1 as shown in FIG. 3A revolving to position P2, P3, P4 or P5 (in practice, the bearing portion 12 can be revolved to any suitable position but not limited to the positions shown in FIG. 3A).

When the rotatable bearing base 1 of the invention is at the position P1 (as shown in FIG. 3B), other connecting jack 74 on the lateral surface 70 of the notebook 7 may be blocked by the bearing portion 12 of the rotatable bearing base 1 or the peripheral electronic unit 2, and a user can not use the connecting jack 74 thereby. At this time, the user can rotate the rotatable bearing base 1 of the invention to position P5 (as shown in FIG. 3C) to solve this problem.

Figure 4:
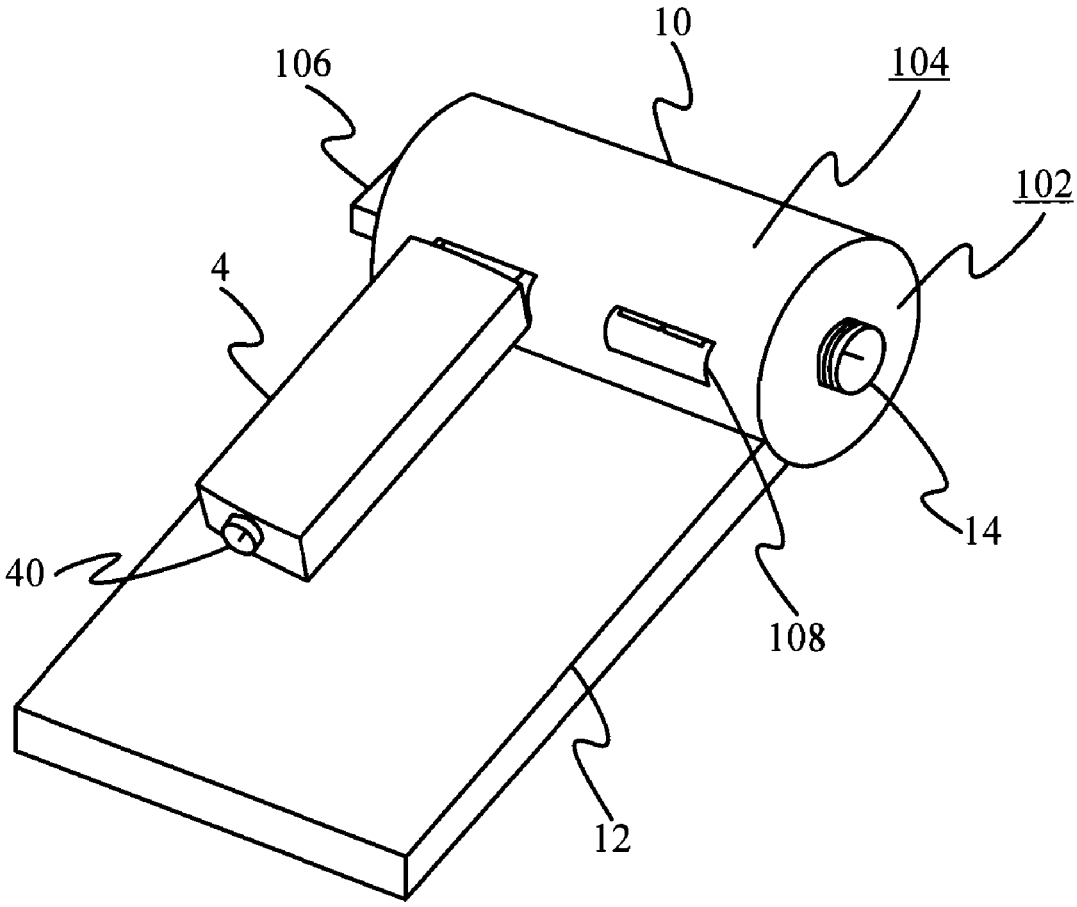
FIG. 4 is a pictorial view illustrating a rotatable bearing base according to an embodiment of the invention.

Please refer to FIG. 4. FIG. 4 is a pictorial view illustrating a rotatable bearing base according to an embodiment of the invention. In the embodiment, the rotatable bearing base 1 of the invention is used for bearing a digital television transceiver 4. The digital television transceiver 4 can receive a wireless signal of a digital television specification.

Especially, the rotatable bearing base 1 of the embodiment further comprises an antenna terminal 14 disposed on the second end surface 102 of the pivot 10 for plugging in an antenna (not shown in the figure). It should be noted that the antenna terminal 14 also can be disposed on the bearing portion 12 and adjust its position depending on situations. Besides, the antenna terminal 14 can be connected to the second connecting portion 108 via a circuit disposed in the rotatable bearing base 1 for transmitting a wireless signal received by the antenna to the digital television transceiver 4. Furthermore, the digital television transceiver 4 receives the wireless signal, processes it, and then transmits it to a connected electronic apparatus (not shown in the figure).

In practice, when the electronic apparatus itself comprises the processing unit of the wireless signal of the digital television specification, the rotatable bearing base 1 of the invention can plug in the antenna only without the digital television transceiver 4, and is used for receiving the wireless signal only. In practice, the rotatable bearing base 1 of the invention also can comprise the processing unit of the wireless signal of the digital television specification inside for processing the wireless signal.

Additionally, the digital television transceiver 4 in the embodiment also can comprise an antenna terminal 40 for plugging the antenna. Thus, in practice, the user can plug the antenna in the antenna terminal 14 of the rotatable bearing base 1 or the antenna terminal 40 of the digital television transceiver 4.

In practice, the specification of the wireless signal received by the digital television transceiver 4 may be, but not limited to a Digital Video Broadcasting Television (DVBT) specification, an Advanced Television System Committee (ATSC) specification or an Integrated Services Digital Broadcasting (ISDB) specification.

Figure 5A:
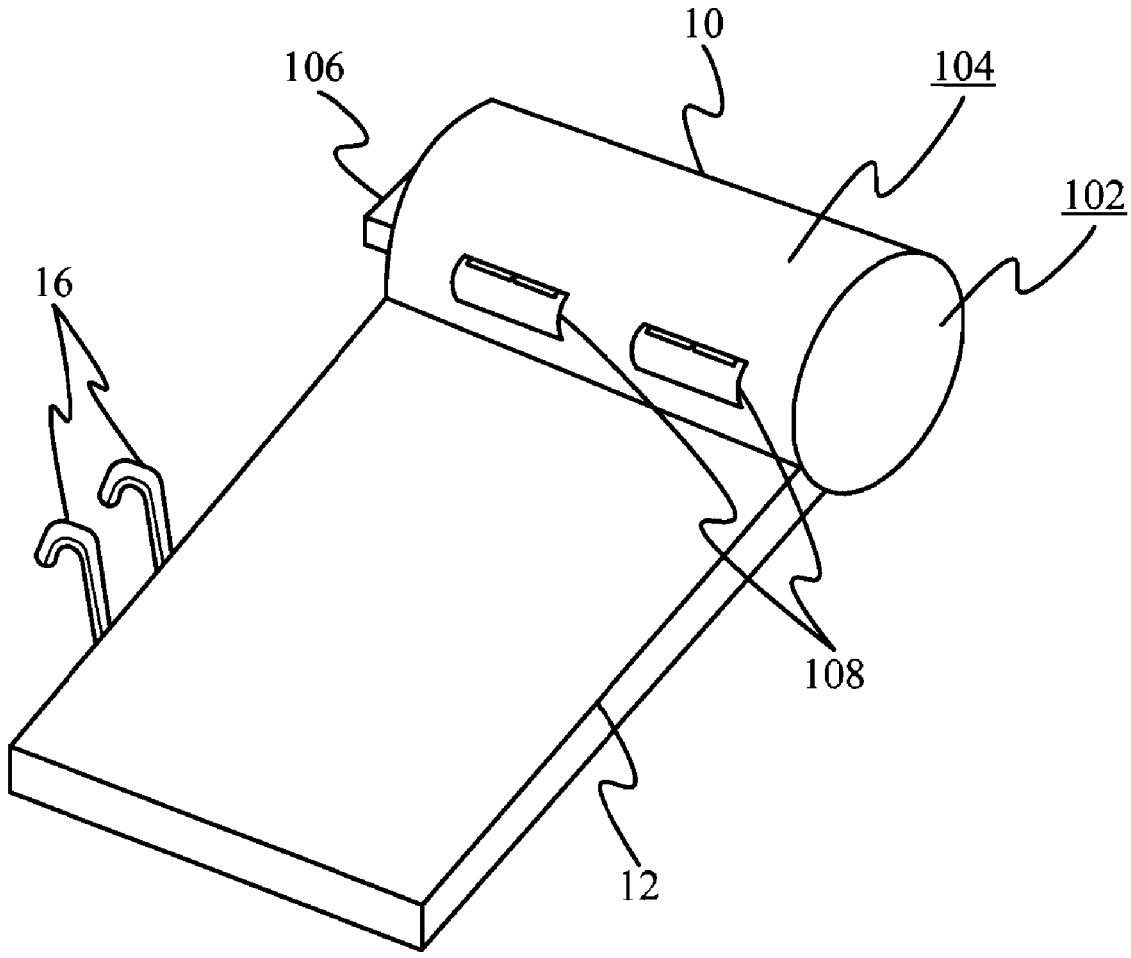
FIG. 5A is a pictorial view illustrating a rotatable bearing base according to an embodiment of the invention.
Figure 5B:
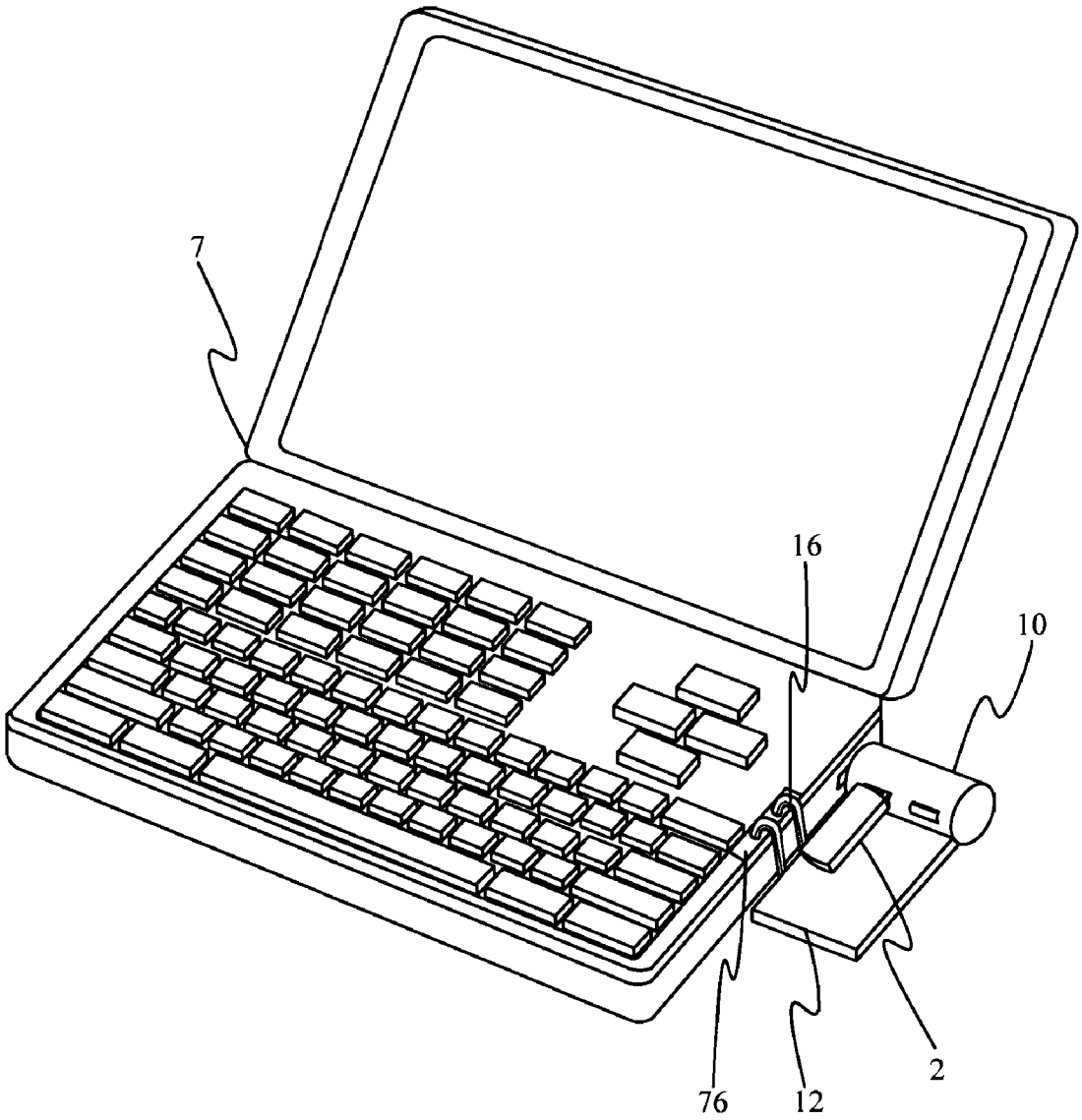
FIG. 5B is a pictorial view illustrating that the rotatable bearing base of FIG. 5A fixes a peripheral electronic unit and connects a notebook.

Please refer to FIG. 5A and FIG. 5B. FIG. 5A is a pictorial view illustrating a rotatable bearing base according to an embodiment of the invention. FIG. 5B is a pictorial view illustrating that the rotatable bearing base of FIG. 5A fixes a peripheral electronic unit and connects a notebook. In the embodiment, the rotatable bearing base 1 of the invention further comprises a fixing portion 16.

The fixing portion 16 is disposed on one side of the bearing portion 12 for hooking the notebook 7 to strengthen the support of the bearing portion 12 for the peripheral electronic unit 2. As shown in FIG. 5A and FIG. 5B, the fixing portion 16 is a clutch. However, in practice, the fixing portion 16 can be designed to have other suitable appearance depending on situations to achieve said purpose. Moreover, as shown in FIG. 5B, the notebook 7 has a recess 76 for fitting the fixing portion 16 to be fixed more stably.

In practice, the fixing portion also can elongate downward to hook the bottom surface of the electronic apparatus. In this case, the bottom surface of the electronic apparatus also can comprise said recess for fitting the fixing portion to be fixed more stably. Practically, the rotatable bearing base of the invention also can comprise the fixing portions elongated upward (as shown in FIG. 5A and FIG. 5B) and downward to strengthen the supporting force by hooking both the top surface and bottom surface of the electronic apparatus simultaneously.

It should be noted that, in practice, besides the example of the notebook described in the present specification, the rotatable bearing base of the invention also can be electrically connected to other suitable electronic apparatuses, for example, a mobile communication apparatus, a desktop, a personal digital assistant (PDA), a table PC or other portable electronic apparatuses but not limited to these.

Compared to the prior art, the rotatable bearing base of the invention provides a support for the peripheral electronic unit, prevent the peripheral electronic unit from naturally drooping because of its weight, and even cause bad contact or unstable electrical connection problems. Furthermore, the rotatable bearing base of the invention can also protect the peripheral electronic unit away from the disturbance of the external force collision, and prevent accidental conditions such as the transmission interruption, the data damage, the electronic apparatus breakdown, etc, caused by the external force collision.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A rotatable bearing base for fixing a peripheral electronic unit, comprising:

a pivot, having two end surfaces and a lateral surface, a first connecting portion being disposed on one of the end surfaces for electrically connecting an electronic apparatus, and at least a second connecting portion being disposed on the lateral surface for electrically connecting the peripheral electronic unit; and a bearing portion elongated from the lateral surface, and the peripheral electronic unit leaning against the bearing portion when it is electrically connected to the second connecting portion.

2. The rotatable bearing base of claim 1, wherein the bearing portion of the rotatable bearing base is capable of revolving on the pivot when the first connecting portion is electrically connected to the electronic apparatus.

3. The rotatable bearing base of claim 1, further comprising:

an antenna terminal, disposed on the pivot or the bearing portion, for plugging an antenna.

4. The rotatable bearing base of claim 3, wherein the antenna terminal is coupled to the second connecting portion, for transmitting a wireless signal received by the antenna to the peripheral electronic unit.

5. The rotatable bearing base of claim 1, further comprising:

a fixing portion, disposed on one side of the bearing portion, for hooking the electronic apparatus to strengthen the support of the bearing portion for the peripheral electronic unit.

6. The rotatable bearing base of claim 5, wherein the fixing portion is a clutch.

7. The rotatable bearing base of claim 1, wherein the first connecting portion is a universal serial bus (USB) connecting portion.

8. The rotatable bearing base of claim 1, wherein the second connecting portion is a universal serial bus (USB) connecting portion.

9. The rotatable bearing base of claim 1, wherein the peripheral electronic unit is a wireless transceiver.

10. The rotatable bearing base of claim 9, wherein the wireless transceiver is selected from a group consisting of an infrared transceiver, a bluetooth transceiver, a digital television transceiver, a global positioning system transceiver and a wireless network transceiver.

11. The rotatable bearing base of claim 10, wherein the digital television transceiver is for receiving a wireless signal of a digital television specification.

12. The rotatable bearing base of claim 11, wherein the digital television specification is a DVBT (Digital Video Broadcasting Television) specification.

13. The rotatable bearing base of claim 11, wherein the digital television specification is an ATSC (Advanced Television System Committee) specification.

14. The rotatable bearing base of claim 11, wherein the digital television specification is an ISDB (Integrated Services Digital Broadcasting) specification.

15. The rotatable bearing base of claim 1, wherein the electronic apparatus is a portable electronic apparatus.

16. The rotatable bearing base of claim 15, wherein the portable electronic apparatus is a notebook, a mobile communication apparatus or a personal digital assistant.

* * * * *